US009589782B2

(12) United States Patent
Papanastasiou et al.

(10) Patent No.: US 9,589,782 B2
(45) Date of Patent: Mar. 7, 2017

(54) CHARGED DROPLETS GENERATING APPARATUS INCLUDING A GAS CONDUIT FOR LAMINARIZATION OF GAS FLOWS

(71) Applicant: FASMATECH SCIENCE & TECHNOLOGY SA, Athens (GR)

(72) Inventors: Dimitris Papanastasiou, Athens (GR); Emmanuel Raptakis, Athens (GR); Diamantis Kounadis, Athens (GR); Alexander Lekkas, Athens (GR); Ioannis Orfanopoulos, Athens (GR)

( * ) Notice: Subject to any disclaimer, the term of this patent is extended or adjusted under 35 U.S.C. 154(b) by 0 days.

(21) Appl. No.: 14/781,618

(22) PCT Filed: Apr. 4, 2014

(86) PCT No.: PCT/IB2014/060441
§ 371 (c)(1),
(2) Date: Oct. 1, 2015

(87) PCT Pub. No.: WO2014/162299
PCT Pub. Date: Oct. 9, 2014

(65) Prior Publication Data

US 2016/0049285 A1 Feb. 18, 2016

(30) Foreign Application Priority Data

Apr. 4, 2013 (GB) ..... 1306114.8

(51) Int. Cl.
*H01J 49/00* (2006.01)
*H01J 49/16* (2006.01)
*H01J 49/04* (2006.01)

(52) U.S. Cl.
CPC ..... *H01J 49/167* (2013.01); *H01J 49/0404* (2013.01); *H01J 49/045* (2013.01); *H01J 49/0495* (2013.01); *H01J 49/162* (2013.01)

(58) Field of Classification Search
CPC ..... H01J 49/00; H01J 49/167; H01J 49/02; H01J 49/04; H01J 49/0404; H01J 49/0431; H01J 49/0445; H01J 49/045; H01J 49/165
(Continued)

(56) References Cited

U.S. PATENT DOCUMENTS 5,543,618 A 8/1996 D'Silva
5,752,663 A * 5/1998 Fischer ..... B05B 7/066 239/424
(Continued)

OTHER PUBLICATIONS

Murray et al., A Laminar Flow Nebulizer for Aerosol MALDI, 1997, Analytical Chemistry, 69, pp. 3613-3616.*

*Primary Examiner* — Jason McCormack
(74) *Attorney, Agent, or Firm* — Franco S. De Liguori; DP IP Group

(57) ABSTRACT

Techniques are provided for generating charged droplets of liquid entrained within a gas flow within a vacuum chamber and for controlling the gas flow. The gas flow with the entrained charged droplets of liquid is jetted into the vacuum chamber along a predetermined jetting axis. The gas jet is received within a gas conduit housed within the vacuum chamber and having a conduit bore coaxial with the predetermined jetting axis. The received gas jet is caused to be restrained to form a laminar gas flow entrained with charged droplets inside of the gas conduit for guiding the entrained charged droplets therealong.

22 Claims, 4 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 6,068,749 | A | 5/2000 | Karger et al. | |
| 2003/0189169 | A1* | 10/2003 | Wells | H01J 49/04 250/288 |
| 2012/0056085 | A1* | 3/2012 | Giles | G01N 27/624 250/282 |
| 2013/0053542 | A1* | 2/2013 | Attygalle | H01J 49/0459 530/300 |

* cited by examiner

CHARGED DROPLETS GENERATING APPARATUS INCLUDING A GAS CONDUIT FOR LAMINARIZATION OF GAS FLOWS

FIELD OF THE INVENTION

The present invention relates to methods and apparatus for the production and/or control of ions, such as for use with a mass spectrometer. The present invention further relates to methods for enhancing ion transmission and improving the sensitivity of mass spectrometers.

BACKGROUND

The advent of Electrospray Ionization (ESI) has expanded the utility of Mass Spectrometry (MS) immensely, initiated the development of novel bio-analytical applications and further supported the advancement of existing analytical methods, particularly approaches associated with liquid chromatography. Fundamental aspects of the ESI process governing the formation of gas phase ions have been discussed and debated over a vast amount of experimental data and theoretical considerations, whilst ongoing investigations are focused on enhancing sensitivity, address suppression effects and introduce design refinements to the ESI source and MS interface. Yet the coupling of the ESI source to a mass analyzer has proved a rather perpetual task, and involves extending the operation of ion optical systems to intermediate pressures, requires consideration of the gas dynamics of under-expanded flows established in the fore vacuum region of mass spectrometers and furthermore necessitates the identification of key design parameters of the ESI source to enhance performance.

Progressive iterations of the original ESI source design involve methods to improve sampling efficiency using multi-capillary inlets or multiple-aperture configurations [U.S. Pat. No. 6,803,565 B2 Smith 2001; U.S. Pat. No. 7,462,822B2, Franzen 2006; U.S. 2011/0127422A1, Hansen 2009], operation at reduced flow rates using multiple emitters [U.S. Pat. No. 7,816,645B2, Kelly 2008] and elevated temperatures to promote desolvation [U.S. Pat. No. 7,199,364B2 Thakur 2007] as well as the construction of pneumatically assisted ESI emitters [U.S. Pat. No. 7,315,021B2, Whitehouse 2005] to aid droplet fission, accommodate higher flow rates and minimize structural unfolding thus control the charge state distribution of high mass ions [Takats et al, Anal Chem 76, 4050-4058 (2004); Wang et al, J Am Soc Mass Spectrom 22, 1234-1241 (2011)]. In other versions the ESI is conceptualized with post ionization capabilities using photons [U.S. Pat. No. 7,109,476B2 Syage 2004] or reagent species [U.S. Pat. No. 8,080,783B2 Whitehouse 2009] as means to address suppression effects enhance sensitivity and selectivity. Other critical parameters such as the position and distance of the sprayer probe relative to the inlet in combination with pneumatic nebulization and curtain gas flows has produced a diverse set of ESI source designs, which is supported by an extensive body of literature. Nevertheless, regardless of any novel design aspects being implemented to enhance performance the vast majority of ESI sources is still attached externally to vacuum and thus the overall ion transfer efficiency, which is practically dictated by the narrow dimensions of inlet capillaries or apertures is estimated to fall below <1% [Page J. et al, J Am Soc Mass Spectrom 18, 1582, (2007)]. Approaches to increase the size of the conductance-limiting inlet system to the mass spectrometer are expected to increase ion transmission and have a significant impact on sensitivity, however, improvements are limited by the practical constraints imposed by the requirement for greater pumping speed. Here, the upper operating pressure threshold established in the fore vacuum region of a mass spectrometer must also be considered as a limitation and currently set to 40 mbar (30 Torr), which is the highest operating pressure of the ion funnel [Kelly R T et al, Mass Spectrom Rev 29, 294-312 (2010)].

The concept of electro-spraying directly inside the fore vacuum region as a means to circumvent the severe ion losses that occur at the atmospheric-pressure interface of a mass spectrometer was proposed early on the development and proliferation of the ESI source [U.S. Pat. No. 5,115,131 Jorgenson et al 1991; U.S. Pat. No. 6,068,749 Karger et al 1997; Gamero-Castano et al, J Appl Phys 83(5), 2428-2434 (1998); Romero-Sanz & de la Mora, J Appl Phys, 95(4), 2123-2129 (2004); Marginean et al, Appl Phys Lett 95, 184103 (2009)], however, there have been very few attempts to prove the practical aspects of such an approach for bioanalytical applications [Page et al, Anal Chem 80, 1800-1805 (2008); Marginean et al, Anal Chem 82, 9344-9349 (2010)]. This first successful implementation comprises of an ESI source operated at low flow rates (<0.5 μL/min) and directly coupled to an ion funnel. The device is known as the sub-ambient pressure ionization (SPIN) source [U.S. Pat. No. 7,671,344B2 Smith et al 2007; U.S. Pat. No. 8,173,960B2 Smith et al, 2009]. The latest design of the SPIN source is a revised version of the original configuration where a first vacuum compartment operated at elevated pressure (~40 mbar) compared to a second vacuum compartment enclosing the ion funnel is introduced. First and second vacuum compartments are in communication via a conductance-limiting aperture of 2-5 mm. A gas supply is used to admit the bath gas in the first vacuum compartment. $CO_2$ or $SF_6$ gases are usually employed to suppress arcing and allow application of the high voltage necessary for the ESI process to ensue.

In spite of the successful implementation of ESI at sub-ambient pressures, the current design of the SPIN source is limited to low flow rates as a result of incomplete desolvation of charged droplets produced at the emitter tip. The residence time inside the first vacuum compartment operated at elevated pressure is short and dictated by the mobility of the charged droplets in the presence of high electric fields established between the ESI tip and the conductance limiting aperture, separated by a few mm only. Ion losses are also expected in the conductance limiting aperture unless sizes greater than several mm wide are used, in which case the pressure differential can no longer be maintained unless substantial temperature gradients are established. Another important limitation of the existing technology is that the construction of the ion funnel prevents from being driven to elevated temperature to promote desolvation. Furthermore, although desolvation and liberation of gas phase ions from charged droplets is possible in the presence of RF fields, the RF field free region established over a significant volume of the ion funnel limits desolvation to near the terminating aperture of the system only.

Higher flow rates in sub-ambient ESI may be achieved with a pneumatic nebulization system employing an ionization process. However, severe ion losses can be expected due to the radial dispersion of charged droplets in the absence of a gas flow re-focusing mechanism. Strong radial velocity components enhance diffusion of charged droplets and product ions significantly affecting instrument sensitivity thus are severely problematic in this regard.

SUMMARY OF THE INVENTION

The invention disclosed herein aims at enhancing the efficiency of the ESI source operated at pressures below atmospheric and inside the fore vacuum region of a mass spectrometer. Preferably, a gas flow focusing mechanism may be employed for capturing and directing charged droplets including product ions. Preferably, the focusing mechanism may be arranged for directing charged droplets towards a pressure limiting aperture. An externally applied electric field in connection with the gas flow focusing mechanism is preferably employed to further enhance transmission. Enhanced efficiency is associated with operation of the ESI source at flow rates near or greater than 1 μL/min, most preferably greater than 10 μL/min. These efficiencies may be achieved whilst restraining radial expansion of charged droplets. In particular, such restraint at or near to the ion optical axis of the system is preferably achieved. Higher flow rates are partly afforded by a novel emitter design equipped with a pneumatic nebulization (gas) system capable of dispersing charged droplets and reducing their size as a means to enhance desolvation. Smaller size droplets are driven to full evaporation and liberation of gas phase ions within a shorter time interval due to the fission process established in the presence of the supersonic gas expansion. The nebulization gas, introduced preferably coaxially with respect to the liquid flow through one or more (e.g. a series of) elongated channels in communication with a high pressure region, undergoes expansion in the first vacuum region reaching supersonic speeds. Droplet fission and dispersion is greatly enhanced under these conditions. The high speed flow is also expected to suppress arcing and permit the application of high voltage necessary for performing ESI. The ESI parts and designs suitable for the generation of a high intensity electric field are well known in the art and are, therefore, not described in any further detail. These are suitable for surrounding a spray tip for the emission of charged droplets.

In an aspect of the invention there is provided an electrospray ionisation source for generating charged droplets of liquid entrained within a gas flow within a vacuum chamber, comprising a liquid insertion capillary for receiving a liquid external to the vacuum chamber and for outputting the received liquid at an output end of the liquid insertion capillary within the vacuum chamber thereby to insert the liquid into the vacuum chamber. A nebulizer part of the ionisation source comprises one or more gas flow channels or ducts for receiving a gas external to the vacuum chamber and for outputting the received gas at an output end of the nebulizer part comprising output end(s) of the one or more of the gas flow ducts within the vacuum chamber thereby to insert a gas flow into the vacuum chamber. A charger part is preferably included for charging the droplets of liquid output by said nebulizer part. Accordingly, a pneumatically assisted electrospray ionization source may be provided. The liquid insertion capillary is located within the output end of the nebulizer part so as to position the output end of the liquid insertion capillary within gas flows output by the nebulizer part, in use, to entrain charged droplets of the inserted liquid within flows of the inserted gas.

The output end of the liquid insertion capillary may be substantially centrally positioned within the output end of the nebulizer part in which said output end(s) of the one or more gas flow ducts are arranged at the periphery of the output end of the nebulizer part.

The nebulizer part may comprise a plurality of said gas flow ducts the output ends of which are arranged substantially symmetrically around the output end of the liquid insertion duct.

The nebulizer part may comprise a gas flow duct the output end of which contains and circumscribes the output end of the liquid insertion capillary located within it. For example, the output end of the liquid insertion capillary may be substantially concentric with output end of the gas flow duct.

The one or more gas flow ducts are preferably substantially parallel to and/or coaxial with the liquid insertion duct.

The one or more gas flow ducts are preferably each capillaries.

The nebulizer part may comprise an output nozzle part positioned at the output ends of the one or more gas flow ducts, and shaped to increase or reduce the cross sectional area of the output end of the nebulizer part relative to the cross sectional area of the output end(s) of the gas flow ducts. This can be shaped to form sonic or super-sonic nozzles.

The liquid insertion capillary preferably extends outwardly beyond the output end(s) of the one or more gas flow ducts so as to project therefrom. In this way, the liquid may be output from the liquid insertion capillary within a desired part/position within a gas jet already formed from the gas output by the gas flow duct(s).

The charger part of the electrospray ionization source may include an electrode located within the vacuum chamber for generating an electrical potential difference relative to the liquid insertion capillary for charging said droplets of liquid which are subsequently entrained within a free jet gas flow discharging within the vacuum chamber, in use. The electrospray ionization source may include the vacuum chamber. The charger part (e.g. said electrode) is preferably an integral part of a gas flow focusing mechanism. This may provide a counter ring-electrode being an integral part of the gas flow focusing element.

The electrospray ionization source may include a gas flow focusing element arranged for restricting radial expansion of said entrained, charged droplets. The gas flow focusing element may be arranged adjacent to the outlet of the nebulizer part and the liquid insertion capillary coaxially therewith, for receiving and focusing gas flows therefrom. The gas flow focusing element may be preferably arranged coaxially with a subsequent gas flow conduit adapted for generating a laminar gas flow therein. The gas flow focusing element may be arranged to output a gas flow into the direction of a subsequent conduit comprising a bore of a duct, where the duct is positioned along a trajectory axis of flow of the gas flow stream and dimensioned so as to restrain the gas flow stream to form a laminar gas flow pattern downstream from an entrance end of the bore. The gas flow focusing element may be preferably an integral part of the subsequent gas flow conduit adapted for generating a laminar gas flow. In this preferred configuration the gas flow focusing element and the conduit may be shaped into an all-in-one/integrated device.

For example, the gas flow focusing element may be arranged to output a focused or highly directed gas flow into a conduit (preferably a conduit with a uniform internal diameter) confining the under-expanded jet entrained with charged droplets. A proportionality coefficient within a range of values within which an acceptable degree of gas flow laminarity is provided inside the conduit, may be used to relate the dimensions of the gas flow focusing element or the duct bore and the gas flow duct/ducts (i.e. those used for pneumatic nebularization of said charged particles), to the pressure conditions according to the relationship:

$$JPR = \frac{1}{k^6}\left(\frac{A}{a}\right)^3$$

where (A) is the cross sectional area of the duct bore or the entrance end of the gas flow focusing element, (a) is the cross sectional area of the output end of the gas flow duct (or the total area of a plurality of such gas flow ducts) employed for pneumatic nebularization of charged droplets (as discussed above), and JPR is the pressure ratio $p_1/p_2$, where ($p_1$) is a pressure at the exit end of the gas flow duct and ($p_2$) is the background pressure of the vacuum chamber. The value of the coefficient k is preferably chosen (e.g. determined empirically) such that the value of JPR preferably does not exceed the value of the cubed ratio $(A/a)^3$.

The gas flow focusing element may be a bore or duct. Preferably, the bore or duct is dimensioned to be capable of accepting substantially the entirety of a jet of said gas flow, entrained with said droplets, as formed or formable by the nebulizer part, in use. The shape of the gas flow ducts of the nebulizer part may be shaped to produce a gas jet at the output end of the nebulizer part. Preferably, this is to cause the dimensions (e.g. width) of the gas jet substantially to fit within, or match, the entrance end of the gas flow focusing element and/or the conduit. The entrance end of the gas flow focusing element is preferably dimensioned to exceed those of the incoming free jet.

The gas flow focusing element maybe arranged for propelling the received gas flow through a restriction (e.g. a waist, hour-glass, pinch, radial constriction or tapering) formed in the bore or duct of the gas flow focusing element, for further shaping the gas flow output by the focusing element at an exhaust output thereof, e.g. as an exhaust flow. The exhaust flow may thus be radially compressed and the kinetic energy of the gas entrained with charged droplets may consequently become highly directed. For example, the operating principles of the radially restricted bore/duct of the gas flow focusing element may rely to those of a Laval nozzle, or a Venturi tube depending on the properties of the gas flow through the system. The bore or duct may be shaped as an asymmetric hourglass shape, having an inlet/entrance opening diameter greater than its outlet/exhaust diameter, with a waist/pinch constriction between them. The bore or duct may be substantially uniform in diameter in those regions between the inlet opening and the waist, and in those regions between the waist and the outlet opening thereof. The diameter of the waist region, at its radially most narrow or constricted part, is most preferably less than the diameter of wither of the inlet and outlet openings.

The bore or duct of the gas flow focusing element may comprise a simple converging structure to funnel the gas flow entrained with droplets.

The gas flow focusing element may be arranged to provide an electrostatic field, a radio-frequency electric field or a combination thereof for further focusing said charged droplets. The gas flow focusing element may be segmented for this purpose. For example, when the gas flow focusing element comprises a constriction or a waist portion, the region between the inlet/entrance and the constriction or waist is preferably comprised of a series of ring electrodes supplied with electrical potentials to form the desired focusing field. The focusing field may provide radial compression of the ion beam and also directional focusing. Other regions or all the regions of the gas flow focusing element may be segmented in this way.

The length of each of the regions of the gas flow focusing element may be adjusted accordingly to satisfy the requirement of forming a laminar flow inside the element.

The gas flow focusing element may comprise a plurality of sub-elements arranged substantially coaxially and in sequence, with each sub-element being spaced from a adjacent sub-element. Electrical potentials may be applied to one or more of the sub-elements to produce a potential difference, and thus an electrical field, between adjacent sub-elements. An electric field is preferably applied between consecutive sub-elements, to maintain charged droplets and product ions near the axis of the gas focusing sub-elements.

A plurality of progressively narrower gas focusing sub-elements may be arranged in series (e.g. coaxially and along the gas flow axis) to enhance radial compression of charged droplets whilst subtracting gas from the main flow.

For example, the radial dimensions of the entrance opening of subsequent sub-elements within the sequence of sub-elements may be less than the radial dimension of the exit/exhaust opening of the preceding sub-element. In this way, the radially outer parts of a gas flow passing out from a preceding sub-element may be "skimmed" from the flow of gas entering the succeeding sub-element—in a manner similar to a "skimmer".

The separation between the tip of the liquid insertion capillary and the inlet entrance/opening of the gas flow focusing element or the conduit (for use in laminar gas flow) is preferably not less than 2 mm and preferably not more than 50 mm, more preferably this separation is in the range of 5 mm to 20 mm.

The length of the gas flow focusing element may depend on the desired properties of the gas flow, that is to say, depending on whether supersonic or subsonic conditions are to be established near the exit end of the system. Subsonic flows may be established for elements with lengths in excess of about 50 mm.

In a second aspect of the present invention the ESI source producing charged droplets in the near-field region of an under-expanded flow is coupled to a novel ion optical system designed aerodynamically to transform the free jet into a laminar subsonic flow. In a preferred embodiment of the present invention the novel ion optical system comprises an elongated conduit with radial dimensions matching those of an under-expanded jet prior to the onset of the transitional/turbulent character of the under-expanded flow. The elongate conduit may have a uniform radial dimension or bore diameter. A gas conduit immersed in an under-expanded flow, which is normally developed in the fore vacuum region of mass spectrometer may preferably possess a 5 mm±2 mm internal diameter bore. The novel ion optical system confines the free jet, reduces gas speed and extends the residence time of charged droplets promoting desolvation thus forming practically an ion guide. The terms gas conduit and ion guide are here used interchangeably. A high temperature environment can also be established over the entire length of the novel ion optical system using heating elements.

Preferred embodiments of the present invention comprising the pneumatically assisted ESI source coupled to the novel ion optical system, preferably with gas flow focusing properties, are described in greater detail using the Drawings.

In another aspect, the invention may provide an ion guide apparatus for transporting a flow of gas entrained with ions comprising, a first source region operated at a first pressure accommodating a liquid insertion capillary and one or more gas insertion ducts, a second vacuum chamber in communication with said first source region through one or more gas insertion ducts controllable to achieve a second pressure therein lower than the source pressure to form a free jet expansion and further disperse liquid into a fine stream of charged droplets, wherein the output end(s) of the gas insertion ducts have a first cross sectional area (a) arranged for jetting said gas into the vacuum chamber along a predetermined jetting axis. The ion guide apparatus includes a gas conduit housed within the vacuum chamber comprising a conduit bore having a second cross sectional area (A) and positioned in register with the output end of the nebulizer part coaxially with the jetting axis for receiving the jet of gas. The ion guide apparatus forms a conduit bore which is operable to control the second pressure for jetting the gas to form a supersonic free jet in the conduit bore with a jet pressure ratio restrained to a value which does not exceed the cubed ratio $(A/a)^3$ of the second cross sectional area and the first cross sectional area thereby with the gas conduit to restrain expansion of the free jet therein to form a subsonic laminar flow in gas restrained by the gas conduit to guide entrained droplets and ions therealong. Here the jet pressure ratio (JPR) is defined as the ratio of the pressure at the sonic surface of the free jet flow to the pressure in the second vacuum region which is the background pressure of the free jet. The charged droplets may undergo evaporation whilst entrained in the gas flow to release bare ions for subsequent ion mobility and/or mass analysis. The conduit bore of the ion guide may comprise temperature control means for controllably raising the temperature thereof to assist in the evaporation of the droplets. A light source, such as an ultra-violet (UV) lamp, may be provided within the wall of the conduit bore or immediately adjacent the outlet end of the bore for ionizing molecules entrained within the gas flow.

The ion guide apparatus may be operable to control the second/background pressure to restrain the jet pressure ratio to a value lower than the value of the cubed ratio by a factor within the range $1.4\times10^{-3}$ to $2\times10^{-7}$, or more preferably to a value lower than the value of the cubed ratio by a factor within the range $6.4\times10^{-5}$ to $5.6\times10^{-7}$, or yet more preferably to a value lower than the value of said cubed ratio by a factor within the range $4.6\times10^{-6}$ to $3.2\times10^{-6}$.

The length of the gas conduit is preferably at least 50 mm. The gas conduit may be comprised of a series of conductive ring electrodes separated by electrical insulators. The guide apparatus may include a field generator apparatus arranged to apply a DC electrical potential across the ring electrodes to generate an electrical field within the gas conduit arranged to focus entrained droplets and ions radially within the gas conduit. The ion guide apparatus may further include a field generator apparatus to apply a RF electrical potential to further assist in ion focusing, desolvation of charged droplets and/or dissociation of adduct species.

The pneumatically assisted ESI source of the present invention may include a second gas flow duct entirely separate from said nebulizer part, and which has a third cross sectional area ($a_3$) arranged for jetting a gas into the vacuum chamber along a predetermined jetting axis. The ESI source may include a second said ion conduit housed within the vacuum chamber comprising a respective second conduit bore having a fourth cross sectional area ($A_4$) and positioned for receiving a jet of gas from the second gas flow duct coaxially with the jetting axis thereof. The control apparatus may be operable to control the pressure in the vacuum chamber for jetting the jet of gas from the second gas flow duct to form a supersonic free jet in the second ion conduit bore with a jet pressure ratio restrained to a value which does not exceed the cubed ratio $(A_4/a_3)^3$ of the fourth cross sectional area and the third cross sectional area. Thus the second ion conduit may restrain expansion of the free jet therein to form therealong a subsonic laminar gas flow. The first and second ion conduits preferably converge and merge into a single ion conduit for merging the laminar flows of said gas jets therein. In this way different ions/molecules may be entrained in the gas flow within the second ion conduit and then merged with the (e.g. different) ions/molecules entrained within the gas flow in the first ion conduit.

In another aspect, the invention may provide a mass spectrometer comprising an electrospray ionization source as described above, and including a differential mobility spectrometer apparatus including an ion inlet opening for accepting ions therein, wherein the gas conduit is located between the electrospray ionisation source and the ion inlet opening with the gas conduit bore positioned in register with the ion inlet opening for presenting thereto ions entrained in said subsonic laminar flow of gas. The differential mobility spectrometer apparatus may be arranged to operate at a vacuum pressure therein substantially matching the second pressure and arranged to present an ion inlet substantially comparable in dimensions to the cross sectional area (A) of the gas conduit.

A geometrical arrangement may be provided for producing a free jet or under-expanded gas flow, typical to those formed in the fore vacuum region of a mass spectrometer equipped with an atmospheric pressure ionisation source, where the free jet flow is preferably arranged circumferentially with respect to an electrospray emitter and where the gas flow is preferably further entrained with charged droplets dispersed into a fine aerosol driven to complete evaporation and production of bare ions at low pressure. The invention may further comprise an ion optical element, preferably operated at elevated temperatures, for example within a temperature range of 100° C. to 400° C., and designed aerodynamically to confine the under-expanded flow and transform the supersonic expansion into a laminar subsonic flow. Preferred embodiments of pneumatically assisted electrospray ionization source are presented, preferably equipped with a gas flow and/or electric field focusing mechanism.

DETAILED DESCRIPTION

Figure 1A:
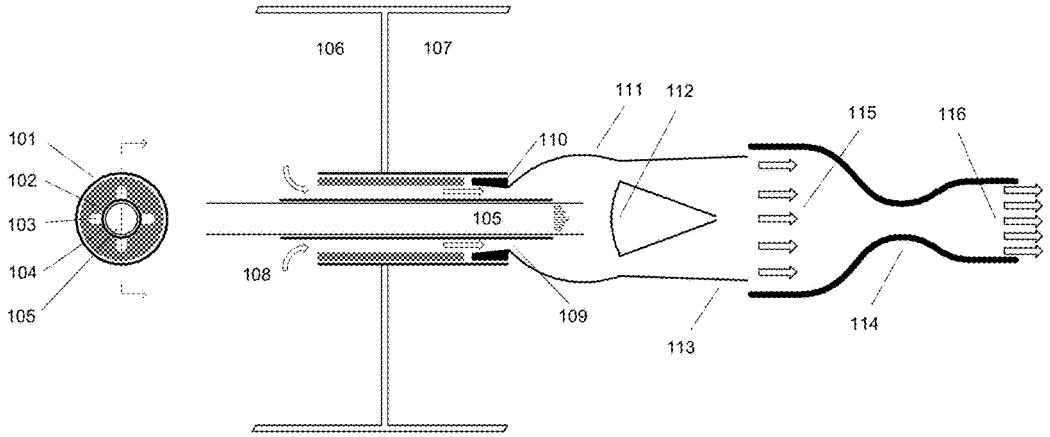
FIG. 1A illustrates an electrospray ionisation (ESI) source according to an embodiment of the invention, equipped with a gas flow focusing mechanism.
Figure 1B:
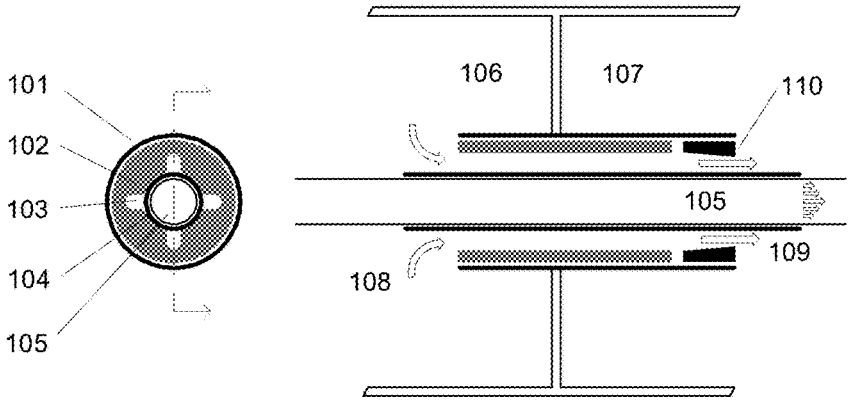
FIG. 1B illustrates an electrospray ionisation (ESI) source according to an embodiment of the invention.

A preferred embodiment of an pneumatically assisted ESI source is illustrated in FIGS. 1A and 1B. It should be understood that although the embodiment of FIG. 1A is illustrated in the embodiments of FIGS. 2 to 6, it is the case that the embodiment of FIG. 1A may be equally well used in the embodiments of FIGS. 2 to 6 such that they include the gas focusing features illustrated in FIG. 1A.

A first high pressure region 106 and a second low pressure region 107 are in communication through an arrangement of concentric tubes and channels or ducts. The space produced between an outer 101 and an inner 104 metallic tube respectively is plugged with a metal seal 102 configured (for example by wire erosion) to establish a series of longitudinal channels 103 arranged circumferentially and used for conducting the nebulization gas. Ceramic or other insulating-material plugs are envisaged. The overall pumping speed of the channel-network is of the order of 0.1-5 L/min. The liquid flow is transported via a fused silica (or metallic) capillary 105, which runs across the entire length of the inner metallic tube 104 and protrudes 0.1-10 mm beyond to form an accurately centered tip emitting charged droplets in the gas phase. The flow at the entrance of the channel 108 is produced preferably by suction and the initially slow moving gas undergoes acceleration in-through the channel to form an under-expanded jet, also termed a free jet, toward the exit 109. Mixing of the multiple jet streams emanating from each of the channels 103 may occur in the space established between the outer 101 and inner 104 metallic tubes respectively. The speed of the gas can be controlled by fitting a shaping bush 110 between tubings 101 and 104 to form either a sonic or a supersonic nozzle. Supersonic nozzles are more likely to enhance droplet fission thus accommodating higher flow rates.

Referring to FIG. 1A, in use, a barrel shock 111 is formed in the gas output from the exits 109, which is followed by a Mach disk 112 and, subsequently, the under-expanded jet region 113.

The tip of the emitter can be arranged to fall behind, in the vicinity of or beyond the Mach disk and/or the region where diagonal shock waves are produced. Dimensions of the fused capillary silica 105 may vary from ~10 μm inner diameter (i.d.) for nL/min liquid flow rates up to 50 μm i.d. or greater for μL/min flow rates. A typical outer diameter (o.d.) for the fused silica capillary is of the order of 150 mm and defines the dimensions of inner metallic tube 104.

Droplets are nebulized and dispersed into the gas phase by the action of a high speed gas while charging is achieved by establishing a potential difference between the emitter tip and a counter ring-electrode in the near-field region of the under-expended jet.

The counter ring-electrode may be an integral part of a gas flow focusing element 114 restricting radial expansion of charged droplets. The gas flow focusing element 114 may be provided in an asymmetric hourglass shape capable of accepting the entire free jet 115 entrained with droplets and propelling those through a restriction further shaping the exhaust flow 116. The exhaust flow 116 is radially compressed and the kinetic energy of the gas entrained with charged droplets becomes highly directed. The operating principles of the hourglass shaped element 114 may rely to those of a Laval nozzle, or a Venturi tube depending on the properties of the gas flow through the system. A gas flow focusing mechanism can also be achieved by utilizing a simple converging structure instead of a hourglass shaped element to funnel the gas flow entrained with droplets. The entrance end of the gas flow focusing element 114 must exceed those of the incoming free jet. Focusing element 114 is preferably segmented to provide a directional electric field for further focusing charged species. A number of progressively narrower gas focusing elements can be arranged in series to enhance radial compression of charged droplets whilst subtracting gas from the main flow. An electric field is preferably applied between consecutive elements to maintain charged species near the axis.

The distance between the emitter tip and the gas flow focusing element is no less than 2 mm and no more than 50 mm, preferably in the order of 5-20 mm. The length of the gas flow focusing element may depend on the desired properties of the gas flow, that is on whether supersonic or subsonic conditions are to be established near the exit end of the system. Subsonic flows may be established for elements with lengths in excess of 50 mm, assuming that the radial dimensions are chosen accordingly.

FIGS. 1A and 1B are illustrative examples of preferred embodiments of the pneumatically assisted ESI source and is not to be regarded as restrictive. FIG. 1A is an illustrative example of a preferred embodiment of the pneumatically assisted ESI source equipped with a gas flow focusing mechanism. FIGS. 1A and 1B are also not to scale, and in particular, certain dimensions maybe exaggerated for clarity of presentation. With reference to FIG. 1B, an example of a a variation of these embodiments may arise by shaping the gas nebulization channels to produce gas jets to match the entrance end of the gas flow focusing element, or simply selecting appropriate tubing dimensions to form a single uniform cylindrical channel for transporting the gas. It may also be desirable to use metallic tips instead of fused silica and therefore extend the range of solvents that can be utilized for analysis. Other variants of the present invention are also envisaged and will become readily apparent to those skilled in the art following the detailed description provided herein.

Figure 2:
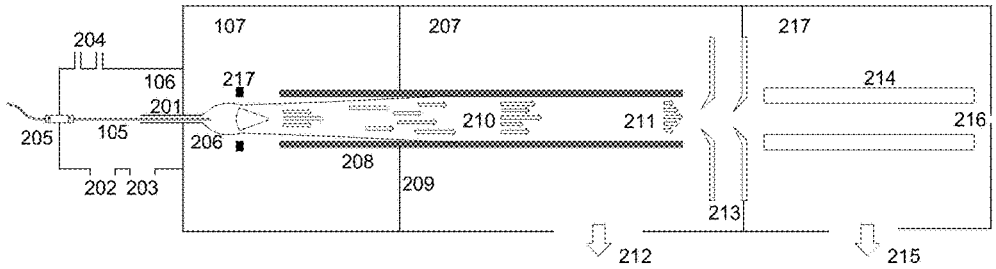
FIG. 2 illustrates an instrument system of the present invention.

FIG. 2 illustrates an instrument system of the present invention where the pneumatically assisted ESI source 201 is disposed between regions 106 and 107. The volume defined within region 106 is isolated and the properties of the buffer gas are accurately defined. The fused silica capillary 105 is connected to a syringe pump or a liquid chromatograph through a union piece 205. The high pressure region 106 is provided with ports 202 and 203 to connect a vacuum pump and a pressure gauge respectively. Pressure in this region can be regulated to near- or sub-atmospheric by control of the pumping speed using a valve or restriction aperture. Pressure above atmospheric is also possible by admitting gas through gas lines 204. Mixtures of gases can also be used to enhance gas-assisted nebulisation efficiency (heavier gases), suppress arcing (electron scavengers) or introduce volatile molecular species to promote interactions with electrosprayed ions in the gas phase.

Charging of the droplets is achieved by maintaining a potential difference between the liquid or the distal end of the ESI emitter relative to counter ring-electrode 217. Referring to FIG. 2, the counter ring-electrode 217 may be an integral part of the gas flow focusing element 208. In this preferred embodiment element 208 is shaped into a uniform conduit (e.g. uniform internal diameter) confining the under-expanded jet entrained with charged droplets.

Classification of under-expanded jets based on the formation and characteristics of a Mach disk, or whether the supersonic jet will present a diamond shock pattern is made possible by introducing the Jet Pressure Ratio, $JPR=p_1/p_2$, where $p_1$ is the pressure at the exit of the nozzle 109, or any other inlet system, more specifically, the pressure at the sonic surface in case of sonic under-expanded free jets, and $p_2$ is the background pressure in the vacuum or expansion region, namely the background pressure. Supersonic nozzles can also be configured by utilizing a divergent nozzle, in which case the speed of the gas exceeds Mach number of unity (M>1) and the distance to the Mach disk is greater. In general, supersonic nozzles are not employed in mass spectrometers for delivering ions into the vacuum region presumably due to the extended penetration depth of the flow, the development of strong turbulent gas motion and associated undesirable effects on ion transmission. It has been generally accepted that the presence of diamond shock patterns only occurs for low JPR values of less than 5, while the formation of a clear Mach disk becomes evident for JPR values greater than 5. Single sonic orifices can reach JPR values of 40 or greater if the background pressure is approximately 1 mbar, which represents a lower pressure threshold attainable in the first stage of mass spectrometers equipped with atmospheric pressure ionization sources. Values of JPR for systems equipped with an inlet capillary can be significantly lower due to the pressure drop across the capillary length. Low JPR values can also be obtained by increasing the background pressure inside the vacuum region, or using enlarged inlet apertures, typically greater than 0.6 mm.

The inventors have realised that a critical aspect with respect to the formation of supersonic free jets with a significant impact on the performance of mass spectrometers is the transitions the gas flow undergoes from the sonic orifice as far as the pressure limiting aperture in the far end of the fore vacuum region. The onset of jet instabilities and the generation of transitional and turbulent flows in the far-field region of the supersonic free jet have a significant impact on transmission efficiency of ions through such narrow apertures used for separating vacuum regions of different pressure. Ion diffusion and ion beam broadening are augmented by the presence of transitional and turbulent flows and significant ion losses on electrodes occur thereby reducing sensitivity.

At its most general, the ion optical system described herein concerns the generation of laminar gas flow (e.g. intermediate pressure laminar flows) in an ion guide apparatus for enhancing transmission efficiency of ions entrained in the gas flowing within the ion guide. The ion guide may be located in the fore vacuum region of a mass spectrometer. The ion guide may comprise a conduit with a bore having a lateral dimension selected to suppress the formation of transitional or turbulent gas flow which would otherwise develop in the far-field region of a free jet expansion. It is desirable to suppress the onset of turbulent flows in the far-field region of an under-expanded free jet and consequently reduce or entirely remove ion losses near apertures used for separating consecutive vacuum compartments operated at lower pressure associated with such gas flows. FIG. 2 shows the supersonic free jet entrained with charged droplets discharging into an elongated gas conduit 208, the dimensions of the conduit being greater than those determined by the boundaries of the jet in the near-field region. The jet emanating through one or more ducts of the pneumatically assisted ESI source is entirely confined by the gas conduit where the gas undergoes a transition from the supersonic into the subsonic flow regime. This is made possible because the free shear layer of the jet encounters the physical boundary of the conduit in the unsteady-laminar region, thus obstructing the onset of instabilities commonly observed in the transitional regime of the flow developed further downstream. The transitional flow is therefore channeled and provided the conduit has a sufficient length, a subsonic laminar flow 211 is developed toward the exit with a quasi-parabolic low velocity profile.

The lateral dimensions of the gas conduit depend on the ratio of the pressure at the exit of the gas inlet and the background pressure, namely the jet pressure ratio as discussed above. High pressure ratios are established when inlet apertures or skimmer cones are employed and the extended radial size of the Mach disk requires a conduit with greater lateral dimensions to be employed for free jet gas flow containment. A significant pressure drop is established across the length of an inlet capillary and therefore the smaller values for JPR require that a conduit with reduced lateral dimensions is most preferably be used instead. More specifically, the inventors disclose a relationship between the dimensionless cross section area of the gas conduit and the jet pressure ratio, JPR, necessary to circumvent ion losses and strong ion diffusional effects related to the onset of transitional and turbulent flows in the far-field region of the jet. The relationship is derived experimentally and relates the cross sectional area of the conduit normalized to the inner cross sectional area of the one or more ducts used for introducing the nebulization gas in the expansion region, with the value of the JPR through a coefficient k:

$$\frac{A}{a} = k^2 \times (JPR)^{1/3} \qquad \text{Equation (1)}$$

where A is the cross sectional area of the gas conduit bore 208, a is the cross sectional area of the gas ducts and k is a coefficient determined experimentally.

Steady-laminar flow conditions toward the end of an elongated conduit, preferably in the subsonic flow regime, and in the absence of turbulence across the entire length of the channel, are developed for a value of k~8, with the dimensions for A and a given in $mm^2$. More specifically, the inventors have identified a range of values for the coefficient k spanning from 5 to 11 where the flow toward the end of the ion conduit will be steady-laminar and a greater range for k extending down to from 3 and up 13 where the flow will remain unsteady-laminar. Flows developed within the range of k=8±5 are desirable for suppressing the onset of turbulence in order to enhance focusing of ions and improve ion transmission through narrow apertures within the laminar flow regime. More preferably, flows developed within the range of k=8±3 are desirable for transforming a supersonic jet into a subsonic steady-laminar flow. Most preferably, gas flow for values of k approximately equal to 8 (eight) are desirable for transforming a supersonic jet into a subsonic steady-laminar flow within a length of the ion conduit.

In a preferred embodiment the ion optical system or gas conduit forming an ion guide 208 comprises a series of conducting rings, in which case the potential difference to form the electrospray can be established between the ESI emitter or liquid and the first ring of the device. The gas conduit of the ion optical system interconnects vacuum regions 107 and 207, separated by a chamber wall 209, although a uniform region is also envisaged accommodating the entire length of the conduit. Pumping is applied in region 207 with the use of a mechanical pump 212. Pressure in regions 107 and 207 spans over an extended range of 1 mbar to an upper threshold defined by the formation of a supersonic jet and for a value of the jet pressure ratio equal or greater than unity (JPR≥1). Free jets with JPR values of less than unity are also envisaged. The high speed flow 206 at the entrance of the ion conduit of the ion optical system is progressively decelerated at 210 and finally transformed into a subsonic fully-developed laminar flow at 211. The gas conduit can be heated to elevated temperatures, preferably in the range of 50° C. to 200° C., and most preferably in the range of 200° C. to 300° C. Greater temperatures can be used if necessary to accommodate higher flow rates delivered to the under-expanded ESI source. The residence time of the droplets and adduct species can be considerably extended inside the hot low-speed gas by increasing the length of the conduit or by application of a DC field gradient to establish a weak electrical force opposite to the direction of the gas flow. Typical lengths for the gas conduit are of the order of 100 mm. Enhanced desolvation can be further achieved in a conduit segmented in the longitudinal direction to form an ion guide comprising a series of rings (~2 mm thickness) and by application of RF fields to said ring electrodes. A set of skimmers 213 or any other DC lens configuration using apertures, preferably designed to guide the excess gas radially outwards while maintaining ions on axis, is positioned at the end of the conduit and used to transfer ions into a subsequent vacuum region 207 evacuated by a second mechanical pump or a turbomolecular pump 215 to a lower pressure. Ions are radially confined in an RF ion guide, for example an octapole RF ion guide, 214 and further transported through an aperture 216 for storage, processing and/or mass analysis.

Conductive hydrophobic materials (graphene or zinc oxide thin film) can be utilized to construct the ion conduit rings or inner surfaces of the ion optical device in order to minimize contamination from solvent adducts and droplets therefore extending operational lifetime of the system.

Figure 3:
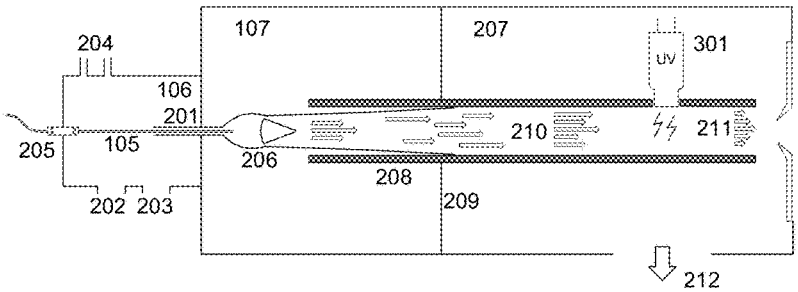
FIG. 3 illustrates a preferred embodiment where an under-expanded ESI source and gas conduit for gas flow laminarization is coupled to a secondary source for post ionisation.
Figure 4:
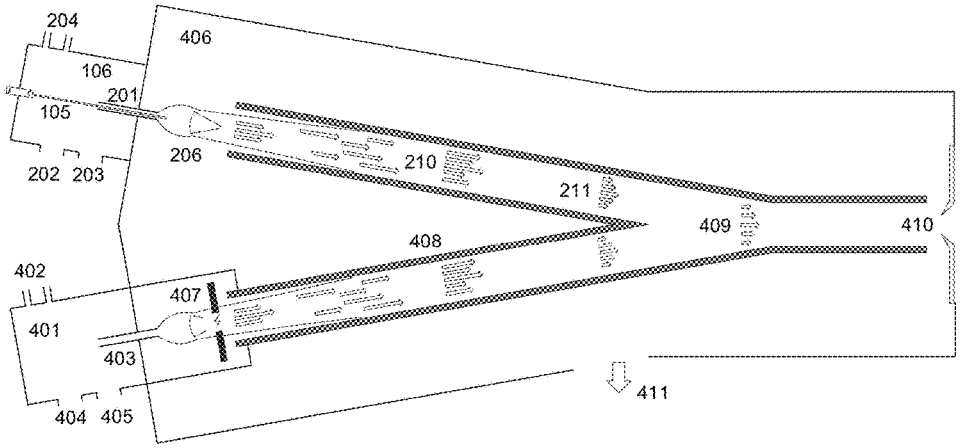
FIG. 4 illustrates the under-expanded ESI source and the low pressure laminarized gas flow developed through the gas conduit and mixed with a secondary laminarized gas flow in communication with a second ionization source.

FIGS. 3 and 4 illustrate preferred embodiments where the under-expanded ESI source is coupled to a secondary source for post ionization or the low pressure gas flow entrained with analyte species is mixed with a secondary gas flow. The secondary gas flow is either seeded with ionic species used for calibration or quantitation, other reagent species for ion-molecule or ion-ion reactions and/or simply used as a hot gas to aid in the desolvation process.

In FIG. 3 a UV lamp 301 is connected to the ion optical system near the exit where the speed of the gas is low and residence time of molecules is longer thus maximizing interaction with photons. Penetration depth of UV radiation at the lower pressures established inside the ion conduit is considerably increased compared to photoionization sources operated near atmospheric pressure. Ionization of molecular ions can be performed with or without the high voltage of the under-expanded ESI source switched on. The utility of the under-expanded ESI source is extended to non-polar species via an electron-ejection-following-UV-photo-absorption process, or by the formation of protonated molecular ions in the presence of a protic solvent. In the case where the high voltage is switched-off the source is strictly acting as a nebulizer/vaporizer system producing desolvated compounds for post ionization based on UV radiation. Infrared radiation can also be utilized for post ionization via a multi-photon absorption process.

FIG. 4 shows yet another preferred embodiment where the under-expanded ESI source is coupled to a second ionization source, for example a discharge source 407. The discharge source 407 comprises a first chamber 401 external to the vacuum compartment 406 and an additional cavity immersed into said vacuum compartment where the discharge is established. Compartment 406 is evacuated by a mechanical pump 411. A capillary 403 is used to transport the gas from the high pressure zone into the low pressure region where the under-expanded flow is established. The external chamber is supplied with gas feedthroughs 402, pumping 404 and pressure gauge 405 ports. The under-expanded flows are merged using a Y-shaped duct 408 in the region 409 where laminar flows are fully developed. Ions are then extracted through a skimmer 410 or other types of DC aperture lenses. In yet another preferred embodiment the discharge ionization source is replaced by a second under-expanded ESI source, which can be used either for delivering reagent ions to perform ion-ion reaction experiments or for providing a reference mass for calibration or quantitation purposes. Merging two separate gas flows into a single channel enables the reaction of positive and negative ions at and beyond the mixing region as long as no DC field gradients are established. In another preferred mode of operation, the second gas flow is driven to high temperatures to aid desolvation of electrosprayed ions and accommodate greater flow rates.

Figure 5:
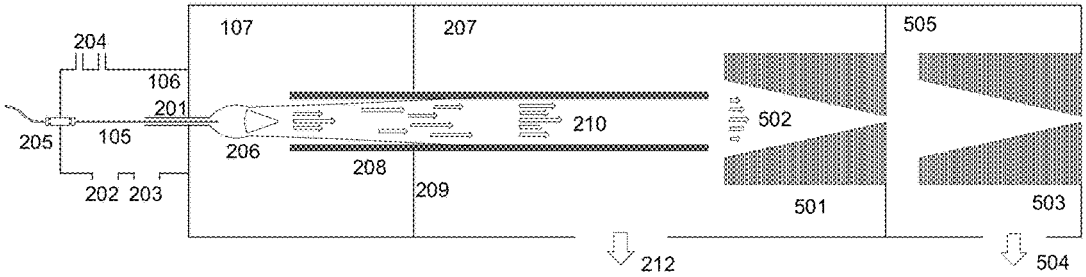
FIG. 5 illustrates a preferred embodiment of the invention where the under-expanded ESI source and gas conduit are coupled to a dual ion funnel system.

A preferred embodiment of the present invention comprises an ion funnel or other types of intermediate pressure RF ion guides (wire ion guides, converging multipole arrangements) disposed at the end of the ion optical system as shown in FIG. 5. The length of the ion funnel 501 is considerably reduced compared to the original design where the distance is necessary for the supersonic jet to breakdown (in case of an atmospheric pressure ionisation source) or to promote desolvation (in case of the SPIN source). The shorter length reduces capacitance and allows for greater RF voltage amplitudes and frequencies to be applied. More importantly, the turbulent character of the under-expanded flow normally established in the far field region of the jet and in the converging part of the funnel near the exit aperture is replaced by a laminar low-speed flow 502. Laminar flows are expected to minimize losses of ions to the electrodes, which would normally occur under turbulent gas flow conditions, and further enhance the focusing strength of the RF and DC electrical fields. A second ion funnel 503 or other appropriate RF ion guide systems are positioned into a subsequent vacuum region 505 connected to a second pump 504 and used for transporting ions to progressively lower pressure regions for trapping, processing and/or mass analysis.

Figure 6:
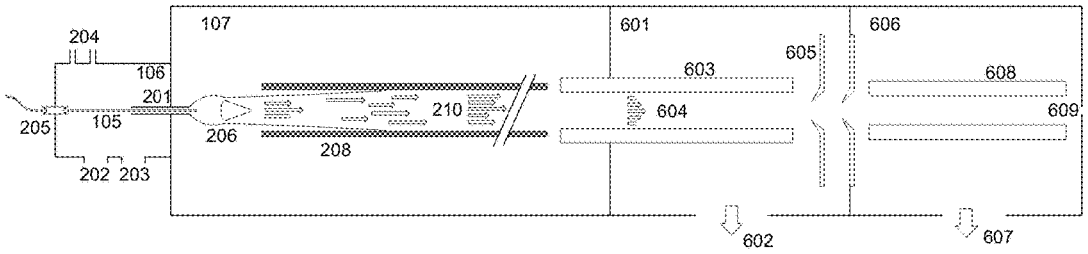
FIG. 6 illustrates a preferred embodiment of the invention where the under-expanded ESI source and gas conduit are coupled to a differential mobility spectrometer.

In yet another preferred embodiment of the present invention illustrated in FIG. 6, the under-expanded ESI source and ion optical system are coupled to a Differential Mobility Spectrometer (DMS) 603. DMS devices rely on the properties of the gas flowing across the gap to transport ions while an asymmetric waveform is applied to establish an alternating field perpendicular to the direction of the flow in order to filter ions based on differences in their mobilities with electric field and pressure. In a preferred configuration, the dimensions of the ion optical system 208 are matched to those of the DMS 603. The two devices are arranged coaxially and the laminar character of the flow 604 is maintained throughout the first 107 and second vacuum 601 regions. In this preferred embodiment pumping 602 is applied in the second vacuum region only, although simultaneous pumping in the first vacuum compartment 107 is also possible. Uniform pumping throughout regions 107 and 601 may also be desirable. The laminar flow 604 established toward the end of the ion optical system is maintained throughout the DMS and directed through a system of skimmers 605, aperture DC lenses or other appropriate RF devices as described above. Ions enter into a subsequent vacuum region 606 where pressure is controlled via a pumping port 607 and further focused as they traverse an RF ion guide 608 through an aperture 609 and into a subsequent vacuum compartment for trapping, processing and/or mass analysis.

The embodiments described herein are intended to illustrate examples of the invention useful for understanding and are not intended to be limiting. Modifications, variants and adjustments to the embodiments described herein, such as would be readily apparent to the skilled person to whom this description is addressed, are intended to be encompassed within the scope of the invention such as is defined by the claims.

The invention claimed is:

1. An apparatus for generating charged droplets of liquid entrained within a gas flow within a vacuum chamber and for controlling the gas flow, the apparatus comprising:

a liquid insertion capillary for receiving a liquid external to the vacuum chamber and for outputting the received liquid at an output end of the liquid insertion capillary within the vacuum chamber to thereby insert the liquid into the vacuum chamber;

a nebulizer part comprising one or more gas flow ducts for receiving a gas external to the vacuum chamber and for outputting the received gas at an output end of the nebulizer part comprising output end(s) of the one or more of the gas flow ducts within the vacuum chamber to thereby insert a gas flow into the vacuum chamber to form a free jet gas flow along a predetermined jetting axis, the liquid insertion capillary being located within the output end of the nebulizer part so as to position the output end of the liquid insertion capillary within the gas flow output by the nebulizer part to entrain charged droplets of the inserted liquid within the flow of the inserted gas;

a charger part for charging the droplets of the liquid output by the nebulizer part; and a gas conduit housed within the vacuum chamber and having a conduit bore positioned in register with the output end of the nebulizer part and coaxially with the predetermined jetting axis, the conduit bore being configured to restrain the free jet gas flow to form a laminar gas flow entrained with charged droplets.

2. An apparatus according to claim 1, wherein the nebulizer part comprises an output nozzle part at the output end(s) of the one or more gas flow ducts for outputting the free jet gas flow, the output nozzle part being shaped to increase or reduce the cross sectional area of the output end of the nebulizer part relative to the cross sectional area of the output end(s) of the one or more gas flow ducts for controlling characteristics of the free jet gas flow.

3. An apparatus according to claim 1, wherein the charger part comprises a conductive element, electrode or wire grid located within the vacuum chamber for generating an electrical potential difference relative to the liquid insertion capillary for charging the droplets of liquid upon dispersion by the free jet gas flow within the vacuum chamber.

4. An apparatus according to claim 1, wherein the length of the gas conduit is at least 50 mm.

5. An apparatus according to claim 1, wherein the gas conduit is comprised of a series of conductive ring electrodes separated by electrical insulators.

6. An apparatus according to claim 5, further comprising a field generator apparatus arranged to apply a DC electrical potential and/or a RF electrical potential across the conductive ring electrodes to generate an electrical field within the gas conduit to form an ion guide arranged to focus entrained droplets and/or ions radially within the gas conduit.

7. An apparatus according to claim 1, further comprising temperature control means for controlling the temperature within the conduit bore of the gas conduit to promote evaporation of the entrained droplets therein.

8. An apparatus according to claim 1, further comprising a light source coupled to the gas conduit for irradiating the conduit bore of the gas conduit with ionizing light to thereby ionize neutrals and ion species entrained within the gas therein.

9. A mass spectrometer including the apparatus according to claim 1.

10. A mass spectrometer according to claim 9, comprising a differential mobility spectrometer apparatus including an ion inlet opening for accepting ions therein; wherein the gas conduit is located between the liquid insertion capillary and the ion inlet opening.

11. A mass spectrometer according to claim 10, wherein the flow of the inserted gas within which the charged droplets of the inserted liquid are entrained is at a source pressure, the vacuum chamber is controllable to achieve a second pressure therein lower than the source pressure, and the second pressure is controllable to form the supersonic free jet in the conduit bore; and wherein the differential mobility spectrometer apparatus is arranged to operate at a vacuum pressure therein substantially matching the second pressure.

12. A mass spectrometer according to claim 10, further comprising a mass analyzer arranged to receive ions output from the differential mobility spectrometer apparatus for mass analysis by the mass analyzer.

13. An apparatus according to claim 1, wherein the conduit bore receives the free jet gas flow such that a supersonic free jet is formed in the conduit bore with a jet pressure ratio $P_1/P_2$ restrained to a value that does not exceed $(A/a)^3$ to form the laminar gas flow entrained with charged droplets, where $P_1$ is the pressure at the output end(s) of the one or more gas flow ducts of the nebulizer part, $P_2$ is the background pressure of the vacuum chamber, A is the cross sectional area of the conduit bore, and a is the cross sectional area of the output end(s) of the one or more gas flow ducts.

14. An apparatus according to claim 13, wherein the jet pressure ratio $P_1/P_2$ is restrained to a value lower than $(A/a)^3$ by a factor within the range $1.4\times10^{-3}$ to $2\times10^{-7}$.

15. An apparatus according to claim 13, wherein the jet pressure ratio $P_1/P_2$ is restrained to a value lower than $(A/a)^3$ by a factor within the range $6.4\times10^{-5}$ to $5.6\times10^{-7}$.

16. An apparatus according to claim 13, wherein the jet pressure ratio $P_1/P_2$ is restrained to a value lower than $(A/a)^3$ by a factor within the range $4.6\times10^{-6}$ to $3.2\times10^{-6}$.

17. An apparatus according to claim 13, further comprising: a second gas flow duct separate from the nebulizer part and arranged for jetting a gas into the vacuum chamber along a predetermined jetting axis; and a second gas conduit housed within the vacuum chamber and comprising a second conduit bore positioned for receiving a jet of gas from the second gas flow duct coaxially with the jetting axis so that a pressure for jetting the jet of gas from the second gas flow duct can be controlled to form in the second gas conduit bore a supersonic free jet with a jet pressure ratio restrained to a value which does not exceed $(A_4/a_3)^3$ to thereby to restrain expansion of the free jet therein to form therealong a laminar gas flow wherein the first and second gas conduits converge and merge into a single gas conduit for merging the laminar flows of the gas jets therein, where $a_3$ is the cross sectional area of the second gas flow duct and $A_4$ is the cross sectional area of the second conduit bore.

18. An apparatus according to claim 1, further comprising ionizing means for ionizing molecules entrained within the gas flow.

19. An apparatus according to claim 1, wherein the output end of the liquid insertion capillary is substantially concentric with an output end of one of the gas flow ducts.

20. An apparatus for generating charged droplets of liquid entrained within a gas flow within a vacuum chamber and for controlling the gas flow, apparatus comprising:

a liquid insertion capillary for receiving a liquid external to the vacuum chamber and for outputting the received liquid at an output end of the liquid insertion capillary within the vacuum chamber to thereby insert the liquid into the vacuum chamber;

a nebulizer part comprising one or more gas flow ducts for receiving a gas external to the vacuum chamber and for outputting the received gas at an output end of the nebulizer part comprising output end(s) of the one or more of the gas flow ducts within the vacuum chamber to thereby insert a gas flow into the vacuum chamber to form a free jet gas flow along a predetermined jetting axis, the liquid insertion capillary being located within the output end of the nebulizer part so as to position the output end of the liquid insertion capillary within the gas flow output by the nebulizer part to entrain charged droplets of the inserted liquid within the flow of the inserted gas;

a charger part for charging the droplets of the liquid output by the nebulizer part; and laminar flow forming means for forming a laminar flow of gas entrained with charged droplets to release ions therein.

21. An apparatus according to claim 20, wherein the laminar flow forming means comprises one of an ion guide element and a gas flow focusing element, the ion guide element having a conduit bore configured to restrain the free jet flow to form the laminar gas flow, and the gas flow focusing element being arranged for restricting radial expansion of the entrained charged droplets to form the laminar gas flow.

22. A method of generating a laminar gas flow entrained with charged droplets, the method comprising: receiving by a nebulizer part a gas flow external to a vacuum chamber and inserting the gas flow into the vacuum chamber from an output end of the nebulizer part; receiving by a liquid insertion capillary a liquid external to a vacuum chamber and inserting the liquid into the vacuum chamber from an output end of the liquid insertion capillary positioned within the gas flow output by the nebulizer part; charging the liquid to form charged droplets released from the output end of the liquid insertion capillary and to entrain the charged droplets within the gas flow; jetting the gas flow with the entrained charged droplets of liquid into the vacuum chamber along a predetermined jetting axis; receiving the gas jet within a gas conduit housed within the vacuum chamber and having a conduit bore coaxial with the predetermined jetting axis; and causing the received gas jet to be restrained to form a laminar gas flow entrained with charged droplets inside of the gas conduit for guiding the entrained charged droplets therealong.

* * * * *